United States Patent [19]

Paolino

[11] 4,045,103

[45] Aug. 30, 1977

[54] GOLF EQUIPMENT STORAGE DEVICE

[76] Inventor: Vincent J. Paolino, 2026 Sagamore Drive, Euclid, Ohio 44117

[21] Appl. No.: 701,408

[22] Filed: June 30, 1976

[51] Int. Cl.[2] ..... A47B 53/00; A47B 81/00

[52] U.S. Cl. ..... 312/198; 211/71; 312/213

[58] Field of Search ..... 312/198, 236, 213, 256, 312/; 248/96; 211/71, 60 G; 150/1.5 B

[56] References Cited

U.S. PATENT DOCUMENTS

| | | | |
|---|---|---|---|
| 294,907 | 3/1884 | Perry | 312/198 |
| 1,991,102 | 2/1935 | Kernahman | 211/71 |
| 2,199,194 | 4/1940 | Cohen | 312/213 |
| 2,530,233 | 11/1950 | Dockray et al. | 312/198 |
| 2,645,353 | 7/1953 | Anderson, Jr. | 211/60 G |
| 3,804,482 | 4/1974 | Smith | 312/236 |

*Primary Examiner*—Paul R. Gilliam

*Assistant Examiner*—Alex Grosz

*Attorney, Agent, or Firm*—Wigman & Cohen

[57] ABSTRACT

A storage cabinet combination for golf-related equipment is disclosed comprising an upstanding cabinet connected to an adjacently situated rack portion. The upstanding cabinet includes an upper shelved portion having a hinged door closure thereon for the storage of golf shoes, ball bags and the like and a substantially open-ended lower portion for receiving a golf cart battery charger. The rack portion of the storage cabinet includes a lower inclined shelf member upon which one or more golf bags are adapted to rest in an upright position and a plurality of arcuate-shaped members which are adapted to at least partly engage the circumference of a golf bag. The storage cabinet is particularly suited for manufacture and packaging in an unassembled kit form which can be readily assembled and finished by the user.

5 Claims, 2 Drawing Figures

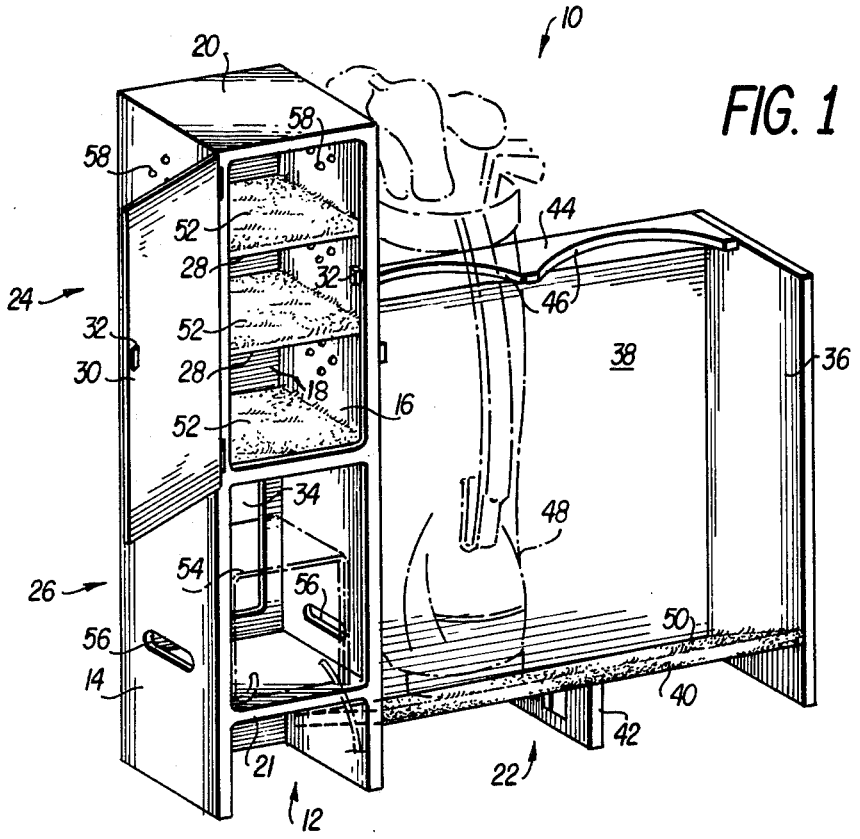
FIG. 1
FIG. 2
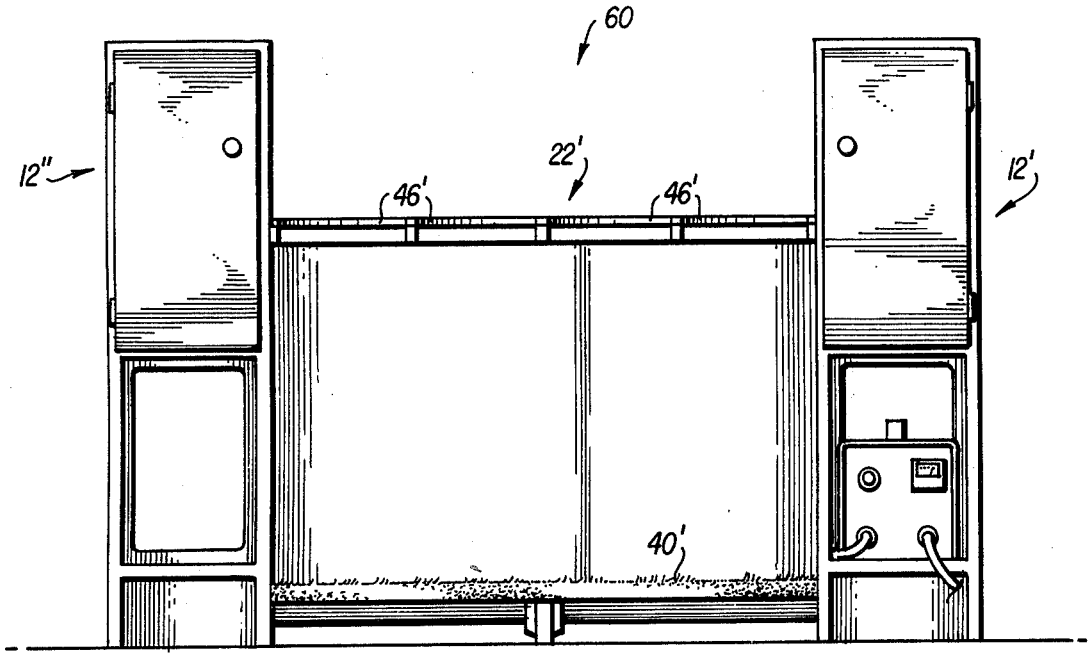

GOLF EQUIPMENT STORAGE DEVICE

BACKGROUND OF THE INVENTION

This invention relates to a new and improved golf equipment storage cabinet device which is especially designed for the storing of golf-related equipment, such as golf bags, golf shoes, golf carts, battery chargers, and the like.

Golfing enthusiasts, both professional and amateur, generally employ a variety of equipment for enhancing their expertise and/or enjoyment of the game. Such equipment will generally include a battery powered golf cart and its associated battery charger, one or more sets of golf clubs, several pairs of golf shoes and other ancillary equipment associated with the maintenance and upkeep of the basic equipment necessary for engaging in the game. All too often this equipment is haphazardly stored in garages, closets and automobile trunks which often results in its becoming misplaced, unnecessarily damaged and, even in some cases, stolen. This problem has become more acute when the golfer owns his own cart which requires a battery charger. Such equipment is expensive and requires care in its use and maintenance. Conventional devices have not generally been found suitable, without expensive modification, for the particular storage problems associated with the aforementioned golf equipment used by golfers today.

For example, in U.S. Pat. No. 1,313,959, there is disclosed a golf bag holder adapted to be secured to the running board of an automobile. This prior art holder includes a frame adapted to enclose one or more golf bags which are secured to the frame by means of a strap. While this holder may provide safe and adequate storage for golf bags during the transportation thereof by automobile, it is not particularly suited for quick and convenient access to the present day large cumbersome golf bags since the bags must be lifted completely out of the top of the frame or inconveniently manipulated through side openings in the frame.

U.S. Pat. No. 2,530,233 discloses a repair unit/work bench combination comprising two cabinets connected by a rubber-covered platform upon which the repairman may place his feet while working. This work bench device is, however, neither intended nor adapted for the storage of golf equipment.

SUMMARY AND OBJECTS OF THE INVENTION

In view of the foregoing, it should be apparent that there still exists a need in the art for a golf equipment storage device which is suitable for safely and conveniently storing in a single location all the equipment generally used by golfers. It is, therefore, a primary object of this invention to provide a golf equipment storage cabinet which is both economical and functional and which can be constructed in assembled or kit form so as to be within the price reach of all golfers.

More particularly, it is an object of this invention to provide a storage cabinet having a combination of components especially constructed for the convenient and proper storage of at least one or more sets of golf clubs, a golf cart battery charger and several pairs of golf shoes.

Another object of this invention is to provide an aesthetically appealing golf equipment storage cabinet including an open rack for the upright storage of one or more sets of golf bags.

Still another object of the invention is to provide a golf equipment storage cabinet, as aforementioned which also includes a ventilated compartment for receiving a golf cart battery charger.

Briefly described, these and other objects of the present invention are accomplished by the provision of a storage cabinet combination comprising an upstanding cabinet connected to an adjacently situated golf bag rack portion. The upstanding cabinet includes an upper shelved portion having a hinged door closure thereon for the storage of golf shoes, ball bags and the like and a substantially open-ended lower portion for receiving a conventional golf cart battery charger. The rack portion of the storage cabinet includes a lower inclined shelf member upon which one or more golf bags, containing golf clubs, are adapted to rest in an upright position. The rack is further provided with a plurality of arcuate-shaped members which are spaced above and to the rear of the forward edge of the inclined shelf and which are adapted to at least partly engage the generally circular cross-section of the upper portion of a golf bag when the same is placed on the shelf member. The shelf member upon which the golf bags rest is rearwardly inclined such that the longitudinal axes of the golf bags are inclined from the vertical in a rearward direction. This arrangement of the shelf helps to prevent forward toppling of the often top-heavy golf bags when they are placed in the rack. Additionally, the arcuate-shaped members are arranged to prevent sidewise toppling of the golf bags when they are positioned on the inclined lower shelf member.

The shelves of the upper and lower portions of the upstanding cabinet and the inclined shelf of the golf bag rack are provided with a cushiony covering, as, for example, an artificial turf material which is manufactured by Monsanto Corporation of St. Louis, Missouri, and sold under the trademark "Astroturf". This covering not only enhances the aesthetic appearance of the storage cabinet combination in that it simulates the naturally-occurring grass of golf courses, but also serves the useful function of preventing unsightly scratching or marring of the shelf surfaces by the relatively sharp golf spikes of golf shoes or by the support feet or surfaces of golf bags.

With these and other objects, advantages and features of the invention that may become hereinafter apparent, the nature of the invention may be more clearly understood by reference to the following detailed description of the invention, the appended claims and to the several views illustrated in the attached drawings wherein:

BRIEF DESCRIPTION OF THE DRAWINGS

FIG. 1 is a perspective view of a preferred embodiment of the storage cabinet combination of the present invention; and FIG. 2 is a front elevation view showing an alternative embodiment of the invention.

DETAILED DESCRIPTION OF A PREFERRED EMBODIMENT

Referring now in detail to the drawings wherein like parts are designated by like reference numerals throughout, there is illustrated in FIG. 1 a storage cabinet combination for golf equipment which is designated generally by reference numeral 10. The storage cabinet combination 10 comprises an upstanding cabinet 12 having vertical lateral walls 14 and 16, rear wall 18 and top wall 20, and an elongated rack portion 22 connected to the lateral wall 16 of the cabinet 12. Upstanding cabinet 12 is divided into upper and lower portions 24 and 26 respectively, the upper cabinet portion 24 being provided with a plurality of vertically spaced shelves 28 which are preferably individually vertically adjustable by any conventional and well-known adjustment means. A hinged closure door 30 is provided for the upper cabinet portion 24 and is provided with a latch mechanism 32 which may be of the common magnetic type. Lower cabinet portion 26 is provided with a shelf 21 and is open toward the front. The rear wall 18 thereof is provided with a large, generally rectangular opening 34, the purpose of which will be hereinafter described.

Elongated rack portion 22 comprises a vertical side wall 36, a rear wall 38 and an inclined shelf 40, the latter being supported on the underside thereof, intermediate its length by a support foot 42. At the upper edges of the walls 36, 38, extending between wall 36 and lateral wall 16 of cabinet 12, there is provided a retaining member 44 which includes a pair of arcuate-shaped portions 46, each of which is adapted to at least partially engage the generally circular circumference of a golf bag 48, as shown in phantom in FIG. 1.

An important feature of the present invention resides in the provision of the inclined shelf 40 which, by reason of its rearward inclination as seen in FIG. 1, is arranged to prevent the forward toppling of a golf bag from the rack portion 22 without the need for the provision of securing straps extending about the circumference of the golf bag as is commonly done in the prior art. The inclined shelf 40 is covered with an artificial turf covering 50, i.e., "Astroturf". Preferably, the shelves 28 of the upper cabinet portion 24 and shelf 21 of the lower cabinet portions 26 are also provided with similar artificial turf material 52.

Lower cabinet portion 26 is particularly adapted for receiving a conventional golf cart battery charger shown in phantom in FIG. 1 and designated 54. The opening 34 in the rear wall 18 of the upstanding cabinet 12 permits air circulation through the lower cabinet portion 26 to thereby help avoid overheating of the battery charger device 54 when in operation. Ventilation openings 56 may also be provided in lateral walls 14 and 16 adjacent the lower cabinet portion 26. As also shown in FIG. 1, the upper cabinet portion 24 is provided with decorative arrangements of ventilation openings 58 in the laterals walls 14 and 16 thereof.

Referring now to FIG. 2, an alternative embodiment of the storage cabinet combination of the present invention is shown comprising an integrally formed dual cabinet arrangement 60 which is particularly suited to store equipment of two golf enthusiasts. It will be apparent to those skilled in the art that this arrangement may also be formed by constructing right-hand and left-hand units according to the embodiment shown in FIG. 1 and abutting the rack portions 22 of the same together in end-to-end relation.

The storage cabinet combination 60 includes right and left upstanding cabinet portions 12' and 12'' respectively, each having a structure and function equivalent to that of the upstanding cabinet 12 of FIG. 1. In this embodiment, the rack portion 22' is provided with four arcuate-shaped portions 46' for receiving as many golf bags. The lower shelf 40' is rearwardly inclined for preventing the forward toppling of the golf bags in a manner similar to the embodiment shown in FIG. 1.

Another important feature of the present invention is that the golf equipment storage device can be made to be sold in kit form, that is, each of the wall and shelf units can be cut to size and packaged in unassembled form with the hardware, etc. necessary for ready assembly and finishing by the user.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A golf equipment storage device comprising, in combination, an upstanding cabinet having upper and lower shelved portions, a rack portion adjacent to said cabinet for receiving at least one golf bag therein in upright position, said rack portion including an upper retaining member and a lower shelf member upon which the golf bag can be securely position, said upstanding cabinet upper shelved portion includes a plurality of shelves for storing shoes or the like, said lower shelved portion having a spacing greater than the spacing between shelves in said upper portion for receiving a golf cart battery charger therein, means provided in said lower shelved portion for circulating air to dissipate heat generated by said battery charger during use, said rack portion being connected to one side of said upstanding cabinet, said upper retaining member including at least one arcuate-shaped portion for at least partly engaging the circumference of a golf bag situated in said rack portion, said lower shelf member being rearwardly inclined from a horizontal plane, said shelf member and the arcuate-shaped portions of said retaining member cooperating to prevent respective forward and sidewise toppling of a golf bag situated therein.

2. A golf equipment storage device according to claim 1, wherein said upstanding cabinet is provided with a plurality of shelves and including an artificial, turf-like material covering said shelf member and the shelves of said upper and lower shelved portion.

3. A golf equipment storage device according to claim 1, including a further upstanding cabinet rigidly connected to the other end of said rack portion, said rack portion being constructed to receive a plurality of golf bags.

4. A golf equipment storage device according to claim 1, wherein said device is provided in a kit form comprising a plurality of wall and shelf members precut to predetermined dimensions for assembly by the user.

5. A golf equipment storage device according to claim 1 wherein said upstanding cabinet and said adjacent rack portion have object receiving openings which face forwardly.

* * * * *